US007189346B2

(12) United States Patent
Lee

(10) Patent No.: US 7,189,346 B2
(45) Date of Patent: Mar. 13, 2007

(54) POLYBENZAZOLE FIBERS AND PROCESSES FOR THEIR PREPARATION

(75) Inventor: Kiu-Seung Lee, Philadelphia, PA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 201 days.

(21) Appl. No.: 10/896,790

(22) Filed: Jul. 22, 2004

(65) Prior Publication Data

US 2006/0019094 A1 Jan. 26, 2006

(51) Int. Cl.
*D01D 5/06* (2006.01)
*D01D 10/06* (2006.01)
*D01F 6/74* (2006.01)

(52) U.S. Cl. ..... 264/184; 264/211.15; 264/211.16; 264/233

(58) Field of Classification Search ..... 264/103, 264/184, 211.15, 211.16, 233
See application file for complete search history.

(56) References Cited

U.S. PATENT DOCUMENTS

| | | | |
|---|---|---|---|
| 4,533,693 | A | 8/1985 | Wolfe et al. |
| 4,703,103 | A | 10/1987 | Wolfe et al. |
| 4,772,678 | A | 9/1988 | Sybert et al. |
| 4,847,350 | A | 7/1989 | Harris |
| 5,089,591 | A | 2/1992 | Gregory et al. |
| 5,276,128 | A | 1/1994 | Rosenberg et al. |
| 5,525,638 | A | 6/1996 | Sen et al. |

FOREIGN PATENT DOCUMENTS

| | | | |
|---|---|---|---|
| EP | 1 106 716 | A | 6/2001 |
| EP | 1 541 726 | A | 6/2005 |
| JP | 2004 076213 | | 3/2004 |
| JP | 2004 076214 | | 3/2004 |
| WO | WO 95/06147 | A | 3/1995 |
| WO | WO 96/10661 | A | 4/1996 |
| WO | WO 2004/003080 | | 6/2003 |
| WO | WO 2004/003272 | | 6/2003 |

OTHER PUBLICATIONS

Zylon Technical Information Bulletin, Toyobo Co., Ltd., Revised Sep. 2001.
Kirk-Othmer, Encyclopedia of Chemical Technology, 4th Edition, vol. 18, 1996, pp. 669-718.
Patent Abstracts of Japan, vol. 2003, No. 12, Dec. 5, 2003 & JP 2004 076213 A (Toyobo Co Ltd), Mar. 11, 2004.

*Primary Examiner*—Leo B. Tentoni

(57) ABSTRACT

The present invention relates to polybenzazaole (PBZ) fibers and processes for the preparation of such fibers. The invention further relates to yarns, fabrics, and articles incorporating fibers of this invention, and processes for making such yarns, fabrics, and articles.

9 Claims, 1 Drawing Sheet

POLYBENZAZOLE FIBERS AND PROCESSES FOR THEIR PREPARATION

BACKGROUND OF THE INVENTION

1. Field of the Invention

Figure 1:
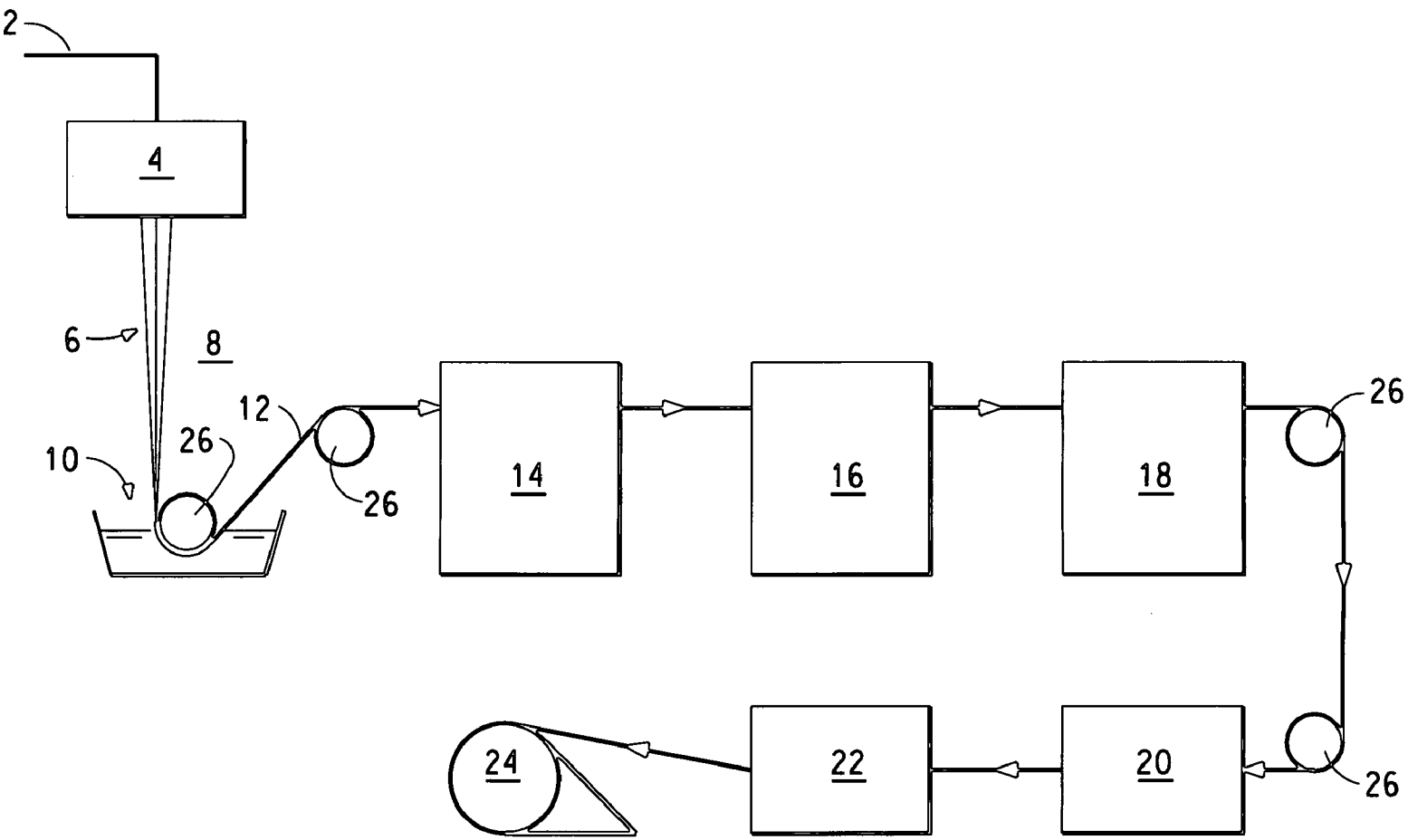

This invention relates to polybenzazole (PBZ) fibers and processes for the preparation of such fibers.

2. Description of Related Art

Fibers prepared from polybenzazole (PBZ) polymers may be prepared by first extruding or spinning a solution of the polymer in a solvent acid which is called a polymer "dope", through a die or spinneret to prepare or spin a dope filament. The dope filament is then drawn across an air gap, with or without stretching, and then coagulated in a bath comprising water or a mixture of water and the solvent acid. If multiple fibers are extruded simultaneously, they may then be combined into a multifilament yarn during or after the coagulation step. The fiber or yarn is then washed to remove most of the solvent acid, and then dried. The physical properties of such fibers and yarns, such as tensile strength, are known to be relatively high.

Polybenzazole polymers and products made therefrom, including fibers and yarns, and methods of their manufacture have been disclosed in, for example, U.S. Pat. No. 4,533,693 (to Wolfe et al. on Aug. 6, 1985), U.S. Pat. No. 4,703,103 (to Wolfe et al. on Oct. 27, 1987), U.S. Pat. No. 5,089,591 (to Gregory et al. on Feb. 18, 1992), U.S. Pat. No. 4,772,678 (Sybert et al. on Sep. 20, 1988), U.S. Pat. No. 4,847,350 (to Harris et al. on Aug. 11, 1992), and U.S. Pat. No. 5,276,128 (to Rosenberg et al. on Jan. 4, 1994). Well-known polybenzazoles are polybenzoxazole (PBO), polybenzthiazole (PBT), and polybenzimidazole (PBI).

PBO spun from a solution of polyphosphoric acid has been found to lose its tensile strength in hot humid air. PBO loses as much as 40% of its strength in 80 days in humid air at 80° C. See the ZYLON® Technical Information Bulletin, revised September 2001 published by Toyobo Co., Ltd. This shortens the useful life of life protection articles, such as bullet proof vests, made from PBO.

U.S. Pat. No. 5,525,638 (to Sen et al. on Jun. 11, 1996) discloses a process for washing polyphosphoric acid from the polybenzazole dope filament to improve the initial tensile strength of the fiber or yarn as well as improve retention of tensile strength of the fiber or yarn following exposure to light and/or high temperatures.

JP2004076214 (to Tadao Kuroki, assigned to Toyobo and published Mar. 11, 2004) discloses a process to improve the strength retention of polybenzazole fiber after exposure to high temperature and high humidity for an extended time period. The final fiber contains a basic organic compound, in the form of a monomer or condensate of the monomer, selected from p-phenylenediamine, m-phenylenediamine and mixtures thereof. The basic organic compound is added to the fiber using a guide oiling method, showering method, or dipping method to fill voids in the fiber before the fiber is dried. The publication explains that the basic organic compound fills the voids of the fiber, thus, external steam is less likely to reach the polybenzazole molecules when the fiber is exposed to high temperature and high humidity for an extended period of time. It further explains that solvent remains in the polybenzazole fiber after the fiber is dried and such non-removed solvent is later neutralized by the base thereby reducing the loss of fiber strength with time.

JP2004076213 (to Tadao Kuroki, assigned to Toyobo and published Mar. 11, 2004) discloses a process to improve the strength retention of polybenzazole fiber after exposure to high temperature and high humidity for an extended time period. This process adds an organic pigment with high heat resistance and a thermal decomposition temperature of 200 degrees C. or higher to fill fiber voids anytime during or after the polymerization of the polymer. Like the prior Japanese publication, this publication explains that the basic organic compound fills the voids of the fiber, thus, external steam is less likely to reach the polybenzazole molecules when the fiber is exposed to high temperature and high humidity for an extended period of time. It further explains that solvent remains in the polybenzazole fiber after the fiber is dried and such non-removed solvent is later neutralized by the organic pigment thereby reducing the loss of fiber strength with time.

However, further improvement is desirable in maintaining the strength of dried polybenzazole fibers.

These and other objects of the invention will be clear from the following description.

BRIEF SUMMARY OF THE INVENTION

The invention relates to a process for removing polyphosphoric acid from a polybenzazole dope filament, comprising:

(a) during or immediately after the dope filament is coagulated, contacting the coagulated dope filament with a washing solution containing water, or a mixture of water and polyphosphoric acid, under conditions sufficient to hydrolyze the polyphosphoric acid; and then (b) contacting the coagulated dope filament with a neutralizing solution containing water and an effective amount of a base under conditions sufficient to neutralize sufficient quantities of the polyphosphoric acid in the filament to a salt of the base and the acid, such that the resulting filament has an average degree of polymerization of the polyphosphoric acid content in the filament less than or equal to 1.5.

The invention further relates to a filament, comprising:

polybenzazole; and a salt of polyphosphoric acid and a base, the salt having an average degree of polymerization less than or equal to 1.5.

The invention is further directed to yarns, fabrics, and articles containing filaments of the present invention.

BRIEF DESCRIPTION OF THE DRAWING(S)

The invention can be more fully understood from the following detailed description thereof in connection with accompanying drawings described as follows.

FIG. 1 is a schematic diagram of the process of the present invention.

DETAILED DESCRIPTION OF THE INVENTION

This invention is directed to polybenzazole (PBZ) filaments and processes for the preparation of such filaments. The invention further relates to yarns, fabrics, and articles incorporating filaments of this invention, and processes for making such yarns, fabrics, and articles.

Filaments of the present invention are prepared from polybenzazole (PBZ) polymers. For purposes herein, the term "filament" is defined as a relatively flexible, macroscopically homogeneous body having a high ratio of length to width across its cross-sectional area perpendicular to its length. The filament cross section can be any shape, but is typically circular. Herein, the term "filament" is used interchangeably with the term "fiber".

The term "polybenzazole" as used herein refers to homopolymers and copolymers of polybenzoxazole (PBO), polybenzthiazole (PBT), and polybenzimidazole (PBI). Suitable polybenzazole homopolymers and copolymers can be made by known procedures, such as those described in U.S. Pat. No. 4,533,693 (to Wolfe et al. on Aug. 6, 1985), U.S. Pat. No. 4,703,103 (to Wolfe et al. on Oct. 27, 1987), U.S. Pat. No. 5,089,591 (to Gregory et al. on Feb. 18, 1992), U.S. Pat. No. 4,772,678 (Sybert et al. on Sep. 20, 1988), U.S. Pat. No. 4,847,350 (to Harris et al. on Aug. 11, 1992), and U.S. Pat. No. 5,276,128 (to Rosenberg et al. on Jan. 4, 1994). Suitable polybenzazoles include poly(benzimidazole) including poly(benzobisimidazole); poly(benzothiazole) including poly(benzobisthiazole); and poly(benzoxazole) including poly(benzobisoxazole). In summary, suitable monomers are reacted in a solution of nonoxidizing and dehydrating acid under nonoxidizing atmosphere with vigorous mixing and high shear at a temperature that is increased in step-wise or ramped fashion from no more than about 120° C. to at least about 190° C. The polybenzazole polymer can be rigid rod, semi-rigid rod or flexible coil. It is preferably a lyotropic liquid-crystalline polymer, which forms liquid-crystalline domains in solution when its concentration exceeds a critical concentration. The intrinsic viscosity of rigid polybenzazole polymers in methanesulfonic acid at 25° C., is preferably at least about 10 dL/g, more preferably at least about 15 dL/g and most preferably at least about 20 dL/g.

Referring to FIG. 1, the polymer is dissolved in a solvent, such as polyphosphoric acid, to form a polymer dope or spinning solution 2. The dope solution 2 should contain a high enough concentration of polymer for the polymer to form an acceptable filament 6 after extrusion and coagulation. When the polymer is lyotropic liquid-crystalline, then the concentration of polymer in the dope 2 is preferably high enough to provide a liquid-crystalline dope. The concentration of the polymer is preferably at least about 7 weight percent, more preferably at least about 10 weight percent and most preferably at least about 14 weight percent. The maximum concentration is limited primarily by practical factors, such as polymer solubility and dope viscosity. The concentration of polymer is preferably no more than 30 weight percent, and more preferably no more than about 20 weight percent.

The polymer dope solution 2 can contain additives such as anti-oxidants, lubricants, ultra-violet screening agents, colorants and the like which are commonly incorporated.

The polymer dope solution 2 is extruded or spun through a die or spinneret 4 to prepare or spin the dope filament 6. The spinneret 4 preferably contains a plurality of holes. The number of holes in the spinneret and their arrangement is not critical to the invention, but it is desirable to maximize the number of holes for economic reasons. The spinneret 4 can contain as many as 100 or 1000 or more, and they may be arranged in circles, grids, or in any other desired arrangement. The spinneret 4 can be constructed out of ordinary materials that will not be degraded by the dope solution 2, such as stainless steel.

Dope solution 2 exiting the spinneret 4 enters a gap 8 between the spinneret 4 and a coagulation bath 10. The gap 8 is typically called an "air gap" although it need not contain air. The gap 8 may contain any fluid that does not induce coagulation or react adversely with the dope, such as air, nitrogen, argon, helium or carbon dioxide. The dope filament 6 is drawn across the air gap 8, with or without stretching. The dope filament 6 is preferably drawn to a spin-draw ratio of at least about 20, highly preferably at least about 40, more preferably at least about 50 and most preferably at least about 60. The spin-draw ratio is defined in this application as the ratio between the take-up velocity of the filaments and the capillary velocity of the dope in the spinneret 4. The shear rate at the spinneret hole wall is preferably in the range of from about 1800–6500 $s^{-1}$. The draw should be sufficient to provide a filament having the desired diameter.

Then the filament 6 is "coagulated" in the coagulation bath 10 containing water or a mixture of water and polyphosphoric acid, which removes enough of the polyphosphoric acid to prevent substantial stretching of the filament 6 during any subsequent processing. If multiple fibers are extruded simultaneously, they may then be combined into a multifilament yarn before, during or after the coagulation step. The term "coagulation" as used herein does not necessarily imply that the dope filament 6 is a flowing liquid and changes into a solid phase. The dope filament 6 can be at a temperature low enough so that it is essentially non-flowing before entering the coagulation bath 10. However, the coagulation bath 10 does ensure or complete the coagulation of the filament, i.e., the conversion of the polymer from a dope solution 2 to a substantially solid polymer filament 12. The amount of solvent, i.e., polyphosphoric acid, removed during the coagulation step will depend on the residence time of the filament 6 in the coagulation bath, the temperature of the bath 10, and the concentration of solvent therein. For example, using a 20 weight percent solution of polyphosphoric acid at a temperature of about 23° C., a residence time of about one second will remove about 70 percent of the solvent present in the filament 6.

The temperature of the coagulation bath 10 is preferably at least about 10° C., more preferably at least about 25° C., and is preferably no greater than about 50° C., more preferably no greater than about 40° C. The residence time of the filament 6 in the coagulation bath 10 is preferably at least about 1 second, and is preferably no more than about 5 seconds. The concentration of acid in the coagulation bath 10 is preferably at least about 0.5 percent by weight, more preferably at least about 20 percent, and is preferably no greater than about 40 percent, more preferably no greater than about 25 percent. For a continuous process, it is preferable to use as low a temperature and high a solvent content as is practical, so that the solvent can be removed as slowly as possible.

Then the coagulated filament or yarn 12 is washed in one or more wash step to remove more and most of the solvent from the filament or yarn 12. The washing of the filament or yarn 12 can be carried out by soaking the filament or yarn 12 in water or a mixture of water and polyphosphoric acid (a washing or wash solution), but is preferably carried out in a continuous process by running the filament through a series of baths and/or through one or more washing cabinets. FIG. 1 depicts one washing bath or cabinet 14. Washing cabinets typically comprise an enclosed cabinet containing one or more rolls which the filament travels around a number of times, and across, prior to exiting the cabinet. As the filament or yarn 12 travels around the roll, it is sprayed with a washing fluid. The washing fluid is continuously collected in the bottom of the cabinet and drained therefrom.

The temperature of the washing fluid(s) is preferably at least about 25° C., more preferably at least about 50° C., and is preferably no greater than about 120° C., more preferably no greater than about 100° C. The washing fluid may also be applied in vapor form (steam), but is more conveniently used in liquid form. The residence time of the filament or yarn 12 in the washing bath(s) or cabinet(s) 14 will depend on the desired concentration of residual phosphorus in the filament or yarn 12, but typical residence times are in the range of from about 180 seconds to about 10 days. In a continuous process, the duration of the entire washing process which includes the time in the coagulation bath and in the washing bath(s) and/or cabinet(s) is preferably no greater than about 200 seconds, more preferably no less than 10 seconds and no greater than about 160 seconds. In a batch process, the coagulated filament can be removed from the coagulation bath 10, wound on cores and placed in hydrolyzation baths for extended periods of time such as up to 10 days or more to ensure adequate hydrolyzation.

Preferably, the surface of the filament or yarn 12 is not allowed to dry after the coagulation step starts and before the washing step(s) are completed. It is theorized, without intending to be bound, that the wet, "never-dried" surface of the filament or yarn 12 is relatively porous and provides paths to wash residual phosphorus from inside the filament or yarn 12. On the other hand, it is theorized that pores inside the filament close when they become dry and do not open even when they become wet again. The closed pores trap residual phosphorus inside the filament or yarn 12.

U.S. Pat. No. 5,525,638 (to Sen et al. on Jun. 11, 1996) teaches that after washing away the polyphosphoric acid from the filament or yarn to less than about 10,000 ppm by weight, and preferably to less than about 4,000 ppm by weight, the coagulated filament or yarn can be contacted with an aqueous solution of an inorganic base, such as in a neutralization bath, under conditions sufficient to neutralize or convert at least about 50 percent of the polyphosphoric acid groups present in the filament or yarn 12 to a salt of the inorganic base and the acid. U.S. Pat. No. 5,525,638 further discloses that this is sufficient to provide the filament or yarn with improved initial tensile strength, as well as improved retention of tensile strength following exposure to light and/or high temperatures.

Under the present invention it has been discovered that prior to any neutralization step, the polyphospohoric acid needs to be totally or substantially hydrolyzed to adequately retain the tensile strength of the fiber after neutralization. Thus, the first step of the present invention is that during or immediately after the dope filament is coagulated, the coagulated dope filament 12 is contacted with a washing solution (such as in a bath or cabinet 14) containing water, or a mixture of water and polyphosphoric acid, under conditions sufficient to totally or substantially hydrolyze the polyphosphoric acid in the filament.

The second step of the present invention follows the first step and is contacting the coagulated filament with a neutralization solution (such as in a bath or cabinet 16) containing water and an effective amount of a base under conditions sufficient to neutralize sufficient quantities of the polyphosphoric acid in the filament to a salt of the base and the acid. For purposes of this invention, the resulting filament has an average degree of polymerization (Ave DP) of the polyphosphoric acid content in the filament of less than or equal to 1.5. Thus, for purposes of this invention, the polyphosphoric acid is "totally or substantially" hydrolyzed when the average degree of polymerization (Ave DP) of the polyphosphoric acid content in the filament after neutralization is less than or equal to 1.5. The neutralization of the polyphosphoric acid in the filament can be evidenced by a reduction in the pH of the neutralization solution in the neutralization solution in bath or cabinet 16. However, the reduction in pH may be undetectable if the amount of base in the neutralization solution far exceeds the amount needed to neutralize the acid.

The average degree of polymerization (Ave DP) of the polyphosphoric acid content of the filament can be determined by solving for Ave DP using the following formula:

$$(M/P)=[(2+(\text{Ave } DP))/(\text{Ave } DP)] \quad (1)$$

where (M/P) is the molar equivalent ratio. The molar equivalent ratio can be determined by measuring the contents of the base cation (M) and phosphorus (P) in the filament after the neutralization step. This can be done by performing an elemental analysis of the alkaline cation and the phosphorus from a neutralized filament sample. One way of performing this elemental analysis is described herein after the heading Test Methods. This particular test method provides the alkaline cation and the phosphorus contents in the filament in parts per million (ppm). In this case, the concentrations in ppm are converted into moles and then the base cation to phosphorus molar equivalent ratio (M/P) is calculated.

Preferably, the molar equivalent ratio (M/P) of the base cation (M) and phosphorous (P) present in the filament to 2.5 to 3.4, more preferably 2.5 to 3.1, and most preferably 2.8 to 3.1.

Polyphosphoric acid (PPA) is defined herein as having the following structure:

(2)

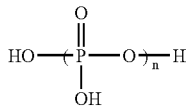

where n is 1 to 12 or higher. Note, under this structure, when n is 1, it is monomeric phosphoric acid. It is believed that when n is greater than 1, due to its polymeric nature, PPA in the filament 12 is strongly associated with the polybenzazole (PBZ), and its removal or extraction during the washing step(s) is much more difficult than washing out monomeric phosphoric acid.

Thus, during the coagulation and/or washing steps, PPA in the filament 12 needs to be hydrolyzed into smaller fragments or species before effective extraction by washing. Through hydrolysis the number of repeat units, n, in the PPA polymer is reduced.

PPA used to make the dope solution 2 has a distribution of different length PPA fragments or species. It is believed, without intending to be bound, that some of PPA fragments or species of different lengths become trapped in the filament 12. The amount and size distribution of these trapped PPA fragments depend on the conditions applied during the coagulation and/or washing steps. If these different length fragments are neutralized by a base, the residual PPA species in the filament become salts of the acid and base as illustrated by the following equation (3) where the neutralizing base used is NaOH.

(3)

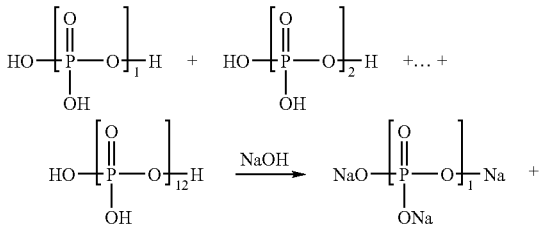

-continued

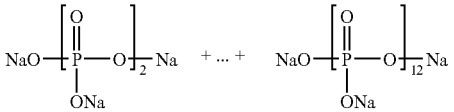

Since fragments with n greater then 1 are more difficult to wash out, some remains still trapped in the neutralized filament after normal washing. However, these PPA salt fragments which remain trapped in the filament after the neutralization step are used in fabrics and other applications but then continue to be hydrolyzed very slowly into smaller fragments by absorbing water from the environment, generating acidic protons. This is illustrated by the following formulas (4) and (5). In formula (4), the starting PPA is as illustrated in formula (2) where n is 3. After exposure to water, hydrolysis occurs resulting in monomeric phosphoric acid and polyphosphoric acid where n is 2. Both the monomeric phosphoric acid and the polyphosphoric acid are acidic having hydroxyl end groups. Further, hydrolysis of the polyphosphoric acid into monomeric phosphoric acid with acidic hydroxyl groups is illustrated in formula (5).

(4)

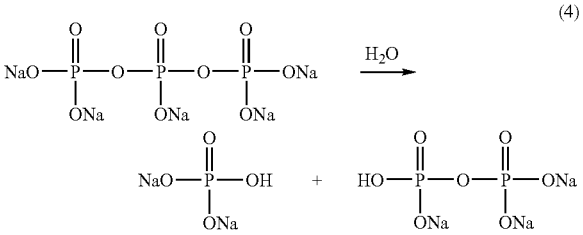

(5)

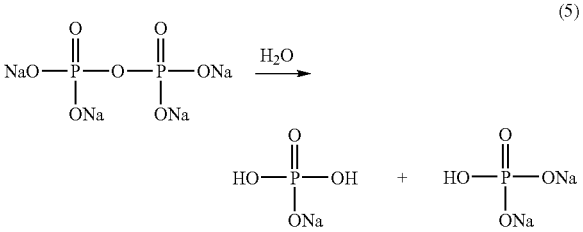

Those PPA species with n greater than 1 that are retained in the filaments used in fabrics and other applications are potential acids sitting in the fiber structure, waiting to be hydrolyzed by the moisture from the environment. For this reason, it is important that PPA has to be hydrolyzed into smaller individual units before the neutralization, in order to achieve long-term stability of the resulting fiber. We solved this problem, by (a) contacting the dope filament with a wash solution in bath or cabinet 14 thereby hydrolyzing all or a significant amount of the PPA and then (b) contacting the filament with a neutralization solution in bath or cabinet 16 containing water and an effective amount of a base under conditions sufficient to neutralize sufficient quantities of the polyphosphoric acid in the filament, such that the resulting filament has an average degree of polymerization of the polyphosphoric acid content in the filament less than or equal to 1.5.

This process of the present invention produces a filament that exhibits superior initial properties and retains those properties much longer than filaments that have not been adequately hydrolyzed and then neutralized prior to drying, even when such neutralized filaments are exposed to high temperatures and high humidity for extended periods of time. When exposed to 80 degrees C. air of 80 percent relative humidity for 80 days, preferably the filament retains at least 70% of its tenacity, more preferably at least 80% of its tenacity, and most preferably at least 90% of its tenacity. Prior to this 80 days exposure test, preferably the filament is at least 22 grams/dtex, more preferably at least 30 grams/dtex, and most preferably at least 44 grams/dtex.

The trapped PPA fragments can be sufficiently hydrolyzed in the coagulation bath and/or washing step(s) to achieve an average degree of polymerization of less than 1.5, by controlling the temperature of the coagulation bath in 10 and/or washing fluid(s) in 12 and the residence time in the coagulation bath 10 and/or washing fluid(s) in 12.

Preferably, in step (a), the washing solution in bath 10 and/or bath or cabinet 12 contains an effective amount of a catalyst for increasing the rate of hydrolysis of the polyphosporic acid. Suitable catalysts include cerous nitrate, cupric sulfate, phosphorylase, or mixtures thereof.

Preferably, in step (b), suitable bases include NaOH, KOH, $Ca(OH)_2$, $Mg(OH)_2$, $Sr(OH)_2$, $Na_2CO_3$, $NaCHO_3$, $K_2CO_3$, $KHCO_3$, $CaCO_3$, $Ca(HCO)_2$, CaO, trimethylamine, triethylamine, triethylenediamine, tributylamine, pyridine, or mixtures thereof. Preferably, the base is water soluble.

After step (b), the process optionally includes the step of contacting the filament with a washing solution containing water to remove all or substantially all excess base. This washing solution can be applied in a washing bath or cabinet 18.

Then the fiber or yarn 12 is dried in a dryer 20 to remove water and other liquids. The temperature in the dryer is typically 80° C. to 130° C. The dryer residence time is typically 10 to 60 minutes. The dryer can be provided with a nitrogen or other non-reactive atmosphere. Then the fiber can optionally be further processed in, for instance, a heat setting device 22. This can be done in a nitrogen purged tube furnace 22 for increasing tenacity and/or relieving the mechanical strain of the molecules in the filaments. Finally, the filament or yarn 12 is wound up into a package on a windup device 24. Rolls and motorized devices 26 are suitably positioned to transport the filament or yarn through the process.

The resulting filament comprises (1) polybenzazole; (2) a salt of polyphosphoric acid and a base having an average degree of polymerization less than or equal to 1.5. Preferably, the molar equivalent ratio (M/P) of the base cation (M) and phosphorous (P) present in the filament is 2.5 to 3.4, more preferably 2.5 to 3.1, and most preferably 2.8 to 3.1.

Preferably, the filament has a linear density of 20 dtex or less, a tenacity of 15 to 50 grams per dtex, an elongation to break of at least 2%, and a modulus of elasticity of at least 500 grams per dtex.

Preferably, the phosphorous content of the coagulated filament is less than about 5,000 ppm by weight, and more preferably, less than 4,000 ppm by weight.

The invention is further directed to yarns comprising a plurality of the filaments of the present invention, fabrics that include filaments or yarns of the present invention, and articles that include fabrics of the present invention. For purposes herein, "fabric" means any woven, knitted, or non-woven structure. By "woven" is meant any fabric weave, such as, plain weave, crowfoot weave, basket weave, satin weave, twill weave, and the like. Plain weave is the most common. By "knitted" is meant a structure produced by interpooping or intermeshing one or more ends, fibers or multifilament yarns. By "non-woven" is meant a network of fibers, including unidirectional fibers (if contained within a matrix resin), felt, and the like. Articles include any end use such as protective apparel, ropes, tarps, sails, etc.

TEST METHODS

The following test methods were used in the following Examples.

Temperature: All temperatures are measured in degrees Celsius (° C.).

Denier is determined according to ASTM D 1577 and is the linear density of a fiber as expressed as weight in grams of 9000 meters of fiber. The denier can be measured on a Vibroscope from Textechno of Munich, Germany. Denier times (10/9) is equal to decitex (dtex).

Tenacity is determined according to ASTM D 3822 and is the maximum or breaking stress of a fiber as expressed as force per unit cross-sectional area. The tenacity can be measured on an Instron model 1130 available from Instron of Canton, Mass. and is reported as grams per denier (grams per dtex).

Elemental Analysis: Elemental analysis of alkaline cation (M) and phosphorus (P) is determined according to the inductively coupled plasma (ICP) method as follows. 2–3 grams of a fiber sample is washed in 500 ml of boiling water for 5 minutes and dried at 105° C. vacuum oven for 1 hour. Accurately weigh 1–2 grams of sample into a quartz vessel of a CEM Star 6 microwave system. Add 5 mls of concentrated sulfuric acid and swirl to wet. Connect a condenser to the vessel and digest using the moderate char method. This method involves heating the sample to various temperatures up to 260° C. to char the organic material. Aliquots of nitric acid are automatically added by the instrument at various stages of the digestion. The clear, liquid final digestate is cooled to room temperature and diluted to 50 ml with deionized water.

The solution can be analyzed on a Perkin Elmer optima inductively coupled plasma device using the manufacturers' recommended conditions and settings. A total of twenty-six different elements can be analyzed at several different wavelengths per sample. A 1/10 dilution can be required for certain elements such as sodium and phosphorus. Calibration standards are from 1 to 10 ppm.

EXAMPLES

The following examples are given to illustrate the invention and should not be interpreted as limiting it in any way. All parts and percentages are by weight unless otherwise indicated.

Continuous Process Inventive Example 1

In this example of the invention, a 14 weight percent solution of polybenzoxazole ("PBO") in polyphosphoric acid ("PPA") with intrinsic viscosity between 30–34 is prepared in a continuous process. Referring to FIG. 1, PBO filaments 6 are extruded at a temperature of about 165 degrees Celsius out of a spinneret 4 into a coagulation bath 10 and combined into a multi-filament fiber 12. The fibers 12 are coagulated in a coagulation bath of water and phosphoric acid 10 having an acid content of about 20 weight percent. The residence time is about 1 second and the bath temperature is about 10 degrees Celsius. Following coagulation, the fibers 12 are fed into an accumulation chamber 14 and contacted with a solution of water and phosphoric acid having an acid content of less than about 10 weight percent. The residence time is about 60 minutes and the bath temperature is about 90 degrees Celsius. The fibers 12 are then fed into a second chamber 16 and contacted with a solution of water and sodium hydroxide having a base content of about 0.5 weight percent. The residence time is about 30 seconds and the bath temperature is about 25 degrees Celsius. The fibers 12 are then fed into a third chamber 18 and contacted with water. The residence time is about 30 seconds and the bath temperature is about 25 degrees Celsius. The fibers 12 are then dried in a dryer 20 and wound into a package on a windup device 24.

Fibers produced by this procedure are then analyzed by elemental analysis. The ppm values are then converted to moles. The molar equivalent ratio (M/P) is calculated. The average degree of polymerization (Ave DP) is calculated using the formula 2 herein. Initial tenacity just after windup is determined. The skein of fiber is then placed in a weatherometer at a temperature of 80 degrees Celsius, 80 percent relative humidity, for 80 days under no tension. The tenacity after this exposure test is determined. Illustrative results are shown below in Table 1.

Continuous Process Inventive Example 2

In this example of the invention, the procedure is the same as Example 1, except that the residence time in the accumulation chamber is reduced. Illustrative results are shown below in Table 1.

Continuous Process Inventive Example 3

In this example of the invention, the procedure is the same as Example 2, except that the residence time in the accumulation chamber is reduced. Illustrative results are shown below in Table 1.

Continuous Process Inventive Example 4

In this example of the invention, the procedure is the same as Example 1, except in the washing chamber in step (a) cerous nitrate is included in the amount of 1 weight percent. The residence time in the accumulation chamber is then reduced.

Batch Process Inventive Example 5

In this example of the invention, a 14 weight percent solution of polybenzoxazole ("PBO") in polyphosphoric acid ("PPA") with intrinsic viscosity between 30–34 is prepared in a batch process. Referring to FIG. 1, PBO filaments 6 are extruded at a temperature of about 165 degrees Celsius out of a spinneret 4 into a coagulation bath 10 and combined into a multi-filament fiber 12. The fibers 12 are coagulated in a coagulation bath of water and phosphoric acid 10 having an acid content of about 20 weight percent. The residence time is about 1 second and the bath temperature is about 10 degrees Celsius. Following coagulation the fibers 12 are placed into a first bath of water and phosphoric acid 14 having an acid content of less than about 10 weight percent. The residence time is about 75 minutes and the bath temperature is about 90 degrees Celsius. The fibers 12 are then placed to a second bath of water and sodium hydroxide 16 having a base content of about 0.5 weight percent. The residence time is about 5 minutes and the bath temperature is about 25 degrees Celsius. The fibers 12 are then placed in a third bath of water 18 having a pH of about 7. The residence time is about 5 minutes and the bath temperature is about 25 degrees Celsius. The fibers 12 can then be dried and processed.

The measurements and calculations performed in Example 1 can be performed on the fibers resulting from this Example 5. Illustrative results are shown in Table 1.

Batch Process Inventive Example 6

In this example of the invention, the procedure is the same as Example 5 except in the second bath cerous nitrate is included in the amount of 1 weight percent. The residence time is then reduced.

TABLE 1

| Ex | M (ppm) | P (ppm) | M (moles) | P (moles) | (M/P) | Ave DP | Initial Tenacity (g/dtex) | Tenacity after exposure test (g/dtex) |
|---|---|---|---|---|---|---|---|---|
| 1 | 3750 | 1500 | 163 | 49.8 | 3.27 | 0.88 | 33 | 29.7 |
| 2 | 4550 | 2000 | 197.8 | 66.4 | 2.98 | 1.01 | 33 | 28.1 |
| 3 | 4510 | 2200 | 196.1 | 73.1 | 2.68 | 1.19 | 33 | 26.4 |
| 5 | 3750 | 1500 | 163 | 49.8 | 3.27 | 0.88 | 33 | 29.7 |

What is claimed is:

1. A process for removing polyphosphoric acid from a polybenzazole dope filament, comprising:

(a) during or immediately after the dope filament is coagulated, contacting the coagulated dope filament with a washing solution containing water, or a mixture of water and polyphosphoric acid, under conditions sufficient to hydrolyze the polyphosphoric acid; and then (b) contacting the coagulated dope filament with a neutralizing solution containing water and an effective amount of a base under conditions sufficient to neutralize polyphosphoric acid in the filament to a salt of the base and the acid, such that the resulting filament has an average degree of polymerization of the polyphosphoric acid content in the filament less than or equal to 1.5, wherein in step (a) a catalyst is present during said contacting for increasing the rate of hydrolysis of the polyphosphoric acid.

2. The process of claim 1, wherein the neutralization of the polyphosphoric acid in the dope filament is evidenced by a reduction in the pH of the neutralization solution.

3. The process of claim 1, wherein the molar equivalent ratio (M/P) of the base cation (M) and phosphorous (P) present in the neutralized filament is 2.5 to 3.4.

4. The process of claim 1, wherein in step (a) the first solution contains an effective amount of a catalyst for increasing the rate of hydrolysis of the polyphosporic acid, the catalyst selected from the group consisting of cerous nitrate, cupric sulfate, phosphorylase, and mixtures thereof.

5. The process of claim 1, wherein the polyphosphoric acid comprises polymer and/or monomer species of the formula $HO—[—HPO_3—]_n—H$ where n is 1 to 12.

6. The process of claim 1, wherein the polybenzazole dope filament comprises a homopolymer or copolymer selected from the group consisting of polybenzoxazole (PBO), polybenzothiazole (PBT), and polybenzimidazole (PBI).

7. The process of claim 1, further comprising:

(c) after step (b), contacting the filament with a washing solution containing water to remove all or substantially all excess base.

8. The process of claim 1, wherein in step (a) the washing solution is 50° to 120° C. and the time that the coagulated dope filament is contacted by the washing solution is 10 seconds to 10 days.

9. The process of claim 1, wherein in step (b) the base is selected from the group consisting of NaOH, KOH, $Ca(OH)_2$, $Mg(OH)_2$, $Sr(OH)_2$, $Na_2CO_3$, $NaHCO_3$, $K_2CO_3$, $KHCO_3$, $CaCO_3$, $Ca(HCO)_2$, CaO, trimethylamine, triethylamine, triethylenediamine, tributylamine, pyridine, and mixtures thereof.

* * * * *